US006922116B1

(12) United States Patent
Gordon et al.

(10) Patent No.: US 6,922,116 B1
(45) Date of Patent: Jul. 26, 2005

(54) GENERATING ARBITRARY PASSIVE BEAM FORMING NETWORKS

(75) Inventors: Scot D. Gordon, Bothell, WA (US); Mitch S. Kaplan, Lake Forest Park, WA (US)

(73) Assignee: Kathrein-Werke KG, Rosenheim (DE)

( * ) Notice: Subject to any disclaimer, the term of this patent is extended or adjusted under 35 U.S.C. 154(b) by 104 days.

(21) Appl. No.: 10/242,311

(22) Filed: Sep. 11, 2002

Related U.S. Application Data

(60) Provisional application No. 60/322,573, filed on Sep. 12, 2001, provisional application No. 60/322,542, filed on Sep. 12, 2001, provisional application No. 60/322,494, filed on Sep. 12, 2001, and provisional application No. 60/342,571, filed on Dec. 20, 2001.

(51) Int. Cl.[7] ..... H01P 3/08

(52) U.S. Cl. ..... 333/128; 333/100; 333/134; 333/136

(58) Field of Search ..... 333/100, 117, 333/124–129, 132, 134, 136

(56) References Cited

U.S. PATENT DOCUMENTS

| | | | | |
|---|---|---|---|---|
| 4,356,462 A | * | 10/1982 | Bowman | 333/128 |
| 5,872,547 A | | 2/1999 | Martek | |
| 5,940,048 A | | 8/1999 | Martek | |
| 6,070,090 A | | 5/2000 | Feuerstein | |
| 6,094,166 A | | 7/2000 | Martek et al. | |
| 6,157,272 A | * | 12/2000 | Kuo et al. | 333/100 |
| 6,172,654 B1 | | 1/2001 | Martek | |
| 6,188,373 B1 | | 2/2001 | Martek | |
| 6,198,434 B1 | | 3/2001 | Martek et al. | |
| 6,246,364 B1 | | 6/2001 | Rao et al. | |

FOREIGN PATENT DOCUMENTS

| | | |
|---|---|---|
| EP | 0504552 A1 | 9/1992 |
| GB | 2367188 A | 3/2002 |

OTHER PUBLICATIONS

European Search Report dated Jan. 8, 2004 in EP 03255682.1.

Rodionov A.M., "A Method of Designating the Pattern–Shaping Network of an Adaptive Antenna Array," Telecommunications and Radio Engineering, Begell House, Inc., New York, NY, US, vol. 47, No. 10, Oct. 1, 1992, pp. 50–54.

U.S. Appl. No. 09/878,599, filed Jun. 11, 2001, Scherzer et al.

U.S. Appl. No. 60/322,494, filed Sep. 12, 2001, Martek et al.

U.S. Appl. No. 60/322,542, filed Sep. 12, 2001, Gordon et al.

U.S. Appl. No. 60/322,573, filed Sep. 12, 2001, Scherzer et al.

U.S. Appl. No. 09/999,261, filed Nov. 15, 2001, Scherzer et al.

U.S. Appl. No. 60/342,571, filed Dec. 20, 2001, Gordon et al.

U.S. Appl. No. 10/242,276, filed Sep. 11, 2002, Scherzer et al.

* cited by examiner

*Primary Examiner*—Robert Pascal
*Assistant Examiner*—Kimberly Glenn
(74) *Attorney, Agent, or Firm*—Fulbright & Jaworski LLP

(57) ABSTRACT

Disclosed are systems and methods which apply design criteria to beam forming network parameters to arrive at a passive beam forming network design. Preferably a beam forming network approach is implemented in two primary stages. Operation of the aforementioned first primary stage may provide a branching configuration which determines how the weights of a desired radiation pattern weight set are allocated in the beam forming network. Preferably, branching nodes are configured to substantially equally distribute power splitting/combining the branches of a node. The aforementioned second primary stage operates to determine the actual physical layout of the various components. Preferably, each branching node is analyzed to determine an optimal physical layout configuration with respect thereto.

42 Claims, 8 Drawing Sheets

GENERATING ARBITRARY PASSIVE BEAM FORMING NETWORKS

CROSS-REFERENCE TO RELATED APPLICATIONS

The present application is related to, and hereby claims priority to, co-pending and commonly assigned U.S. provisional patent applications Ser. No. 60/322,573 entitled "Co-Located Antenna Array for Passive Beam Forming," filed Sep. 12, 2001, Ser. No. 60/322,542 entitled "Automated Process for Generating Arbitrary Passive Beam Forming Networks," filed Sep. 12, 2001, Ser. No. 60/322,494 entitled "Inexpensive Fabrication Technique for Making Antenna Element Cards," filed Sep. 12, 2001, and Ser. No. 60/342,571 entitled "Co-Located Antenna Array for Passive Beam Forming," filed Dec. 20, 2001, the disclosures of which are incorporated herein by reference in their entirety. The present application is also copending and related to commonly assigned U.S. patent applications Ser. No. 10/242,276 entitled "Co-Located Antenna Array for Passive Beam Forming," concurrently filed herewith, Ser. No. 09/878,599 entitled "Passive Shapable Sectorization for Cellular Networks," filed Jun. 11, 2001, and Ser. No. 09/999,261 entitled "Passive Shapable Sectorization Antenna Gain Determination," filed Nov. 15, 2001, the disclosures of which are incorporated herein by reference in their entirety.

TECHNICAL FIELD

The invention relates generally to wireless communication and, more particularly, to providing passive beam forming network configuration.

BACKGROUND OF THE INVENTION

It may be desirable to provide passive beam forming networks for complex beam forming using antenna arrays such as those shown and described in the above referenced patent applications entitled "Co-Located Antenna Array for Passive Beam Forming." For example, for different environments it may be desirable to provide different radiation patterns to effectively optimize performance of a communication system.

A passive beam forming network effects a radiation pattern using an antenna array having a particular geometry, wherein the antenna array comprises individual arrays or individual antennas which are slaved together. Accordingly, a beam forming network may be designed which, when utilized with an antenna array having a particular geometry, results in a desired radiation pattern. In operation, a passive beam forming network distributes signal energy to/from the individual elements in an antenna array.

For example, a passive beam forming network distributes the energy to each of the elements in the array such that each element is driven with a certain amplitude and phase in relation to other ones of the elements in the array. Such amplitudes and phases comprise what are often referred to as "weights", wherein a set of weights (amplitude and phase values) may be associated with a given radiation pattern. An individual weight is associated with an individual antenna element or element array, e.g., an antenna element column, in the antenna array. A particular set of weights to provide a desired radiation pattern is dependent on the specific antenna structure utilized. Accordingly, once a desired radiation pattern is known, that uniquely determines a set of weights that may be utilized in providing the radiation pattern using a particular antenna configuration.

In the past, designing complex beam forming networks has required the talents of a skilled radio frequency (RF) engineer and, typically, many hours of design time. For example, implementing a particular desired radiation pattern typically would require an RF engineer to design a beam forming network using his background and experience in designing these networks as well as computer aided drafting (CAD) tools and the like to layout the components of a feed network using trial and error and some level of intuition. For example, the RF engineer may first determine how to divide the signal power in the beam forming network to arrive at the desired amplitudes of the weight set. Thereafter, the RF engineer may work to derive a component layout, such as on a printed circuit board (PCB) using, for example, microstrip or stripline technology.

Accordingly, once an RF engineer is given a desired radiation pattern's requirements, i.e., the weights that are to be incorporated into a beam forming network, the engineer might go through a process of deciding the structure and the layout of the beam forming network. This could be a lengthy process, on the order of a few days. If it were desired to generate many beam forming networks, such a process would require many RF engineers and/or considerable lead time. Such an approach, in addition to being an expensive proposition, does not readily facilitate the manufacture of a large number of such passive beam forming networks, such as for providing unique radiation patterns throughout a communication network and/or to provide reconfigured beam forming networks in response to topology and morphology changes in the network.

A need therefore exists in the art for a beam forming network design approach which is less dependent upon the skills of an individual, such as an RF engineer.

BRIEF SUMMARY OF THE INVENTION

The present invention is directed to systems and methods which apply design criteria to beam forming network parameters to consistently arrive at a passive beam forming network design. Preferably such passive beam forming network designs are arrived at without design input from a highly skilled individual, such as an RF engineer. Accordingly, embodiments of the present invention may be substantially automated, thereby facilitating the efficient and rapid design and/or manufacture of complex passive beam forming networks.

Preferred embodiments of the present invention provide a beam forming network design approach implemented in two primary stages. A first such primary stage operates to determine how the weights of a desired radiation pattern weight set are to be allocated in the beam forming network. A second such primary stage operates to determine a satisfactory layout of components to provide the desired weight set with a feed network using the previously determined allocation of weights in the network.

According to a preferred embodiment, a passive beam forming network is comprised of a number of microstrip or stripline feed paths disposed in a tree-like structure, wherein branching nodes of the tree-like structure provide power division/combining. For example, the microstrip line widths of each such branch of a branching node may determine the ratio of power splitting/combining among the branches of the branching node. Accordingly, operation of the aforementioned first primary stage may provide a branching configuration which determines how the weights of a desired radiation pattern weight set are allocated in the beam forming network. For example, a passive beam forming network may be designed in which one input is divided into multiple branches at a first node, each of those branches again divided into multiple branches at subsequent nodes, and so on. In this way, a network may be designed with one input and an arbitrary number of outputs, such as a number of outputs corresponding to antenna elements or element arrays in a phased array antenna structure.

According to preferred embodiments, the number of branches at any particular node may be any number (e.g., 1, 2, 3, or 4) according to the present invention. However, embodiments of the present invention operate to configure branching nodes to substantially equally distribute power splitting/combining among the branches of a node (i.e., select a configuration in which power is split/combined approximately ½ and ½ at a 2 branch node, approximately ⅓, ⅓ and ⅓ branch node, etcetera). Although beam forming network configurations provided according to the present invention will include unequal power division, selecting configurations in which power is split/combined at a particular branching node substantially equally may be utilized to minimize the difference between microstrip line widths at any one node. Accordingly, a number of branches utilized at any particular branching node may be selected according to the present invention to provide as near an equal split/combination of power as may be implemented while meeting other design criteria of an embodiment of the present invention.

Moreover, configuration of branching nodes to substantially equally distribute power splitting/combining among the branches is preferably accomplished with respect to all branching nodes within the beam forming network. Accordingly, preferred embodiments of the present invention order the weights of the weight set according to a power thereof. This ordered set of weights may be utilized to determine branching node configurations which both provide as near an equal split/combination of power as may be implemented with respect to a particular branching node as well as assuring subsequent branching nodes are also provided with as near an equal split/combination of power as may be implemented.

According to a preferred embodiment, once a branching configuration which determines how the weights of a desired radiation pattern weight set are allocated in the beam forming network is arrived at, the aforementioned second primary stage operates to determine the actual physical layout of the various components (e.g., striplines, microstrips, branching nodes, ¼ wave impedance transform, et cetera). According to a preferred embodiment, design criteria utilized in determining physical layout of a beam forming network include: 1) the final branches have only a corresponding weight of the weight set associated therewith; 2) no two branches or sections of the feed network cross; 3) each segment of the layout is as far from its neighbors as is possible to minimize coupling between the various signals; and 4) the entire layout fits within a border determined by the physical constraints imposed by the size of a structure upon which or into which the feed network is to be disposed.

According to a preferred embodiment, each branching node is analyzed to determine an optimal physical layout configuration with respect thereto. Preferably, multiple iterations of such analysis are utilized to arrive at a final optimal or nearly optimal configuration of the beam forming network. According to an embodiment of the present invention, particular design criteria are incremented between one or more such iterations to converge upon a solution satisfying desired design criteria.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
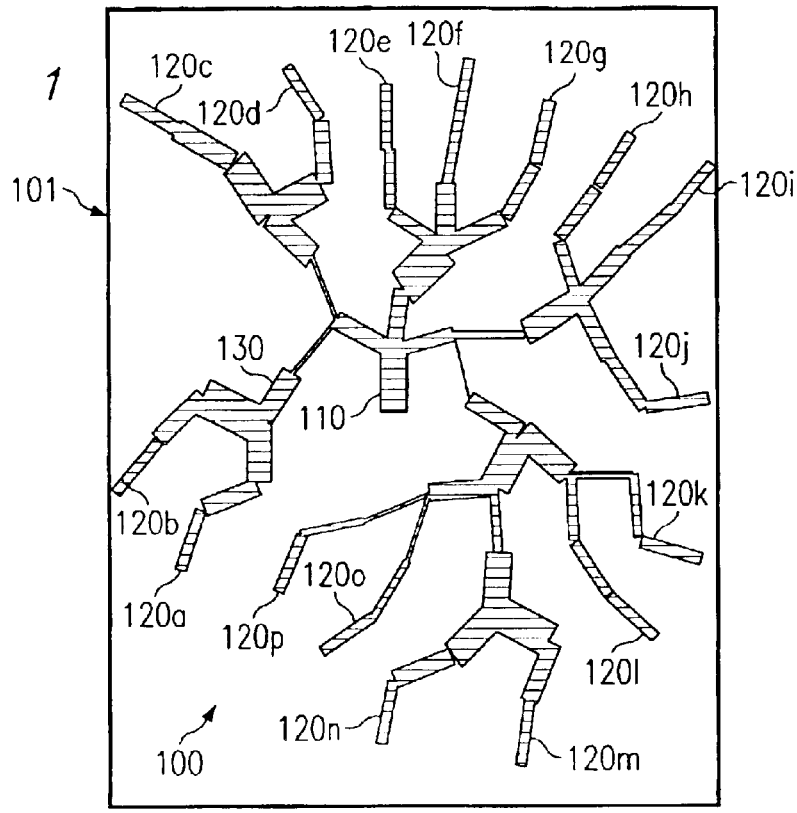
FIG. 1 shows a passive beam forming network provided according to an embodiment of the present invention.

Providing radiation pattern shaping, such as shown in the above referenced patent applications entitled "Passive Shapable Sectorization for Cellular Networks" and "Passive Shapable Sectorization Antenna Gain Determination," may utilize a passive beam forming network that produces a fixed number of RF outputs (e.g., 8, 12, 16, etc.) with specified complex weights (gains and phases), corresponding to the excitation signals fed to antenna element columns of an antenna array. Such a passive beam forming network may be implemented by etching a series of microstrip lines on a PCB board, referred to herein as a "personality card". FIG. 1 shows an illustrative embodiment of board 101 having passive beam forming network 100 of the present invention disposed thereon.

The aforementioned weights are preferably derived from the desired antenna radiation pattern and a personality card of the present invention may instantiate the weights by dividing the power input at an input node (e.g., input node 110 of FIG. 1) through a series of branching lines. The relative impedances of the branches emanating from each branch node may determine the power division from that node. According to a preferred embodiment, the impedance of each branch is determined, for example, by its line-width. The relative phase of each path through the network may be determined by the total physical path-length from signal input (e.g., input node 110 of FIG. 1) to its respective terminal or output node (e.g., output nodes 120*a*–120*p* of FIG. 1).

It is envisioned that for communication systems into which the aforementioned personality cards are to be deployed, each desired radiation pattern may be unique and, thus, each personality card may also be unique. Moreover, it is anticipated that desired radiation patterns will change over time, such as seasonally and/or in response to topological and morphological changes within a service area of the radiation pattern. Accordingly, design of a relatively few, fixed number, of beam forming networks will likely be unable to address demand for personality cards. Further, the turnaround time from desired radiation pattern parameter determination (i.e., specification of complex weights) to deployment of a physical personality card may be very short; such as on the order of less than one day. Accordingly, embodiments of the present invention provide an automated process for providing design of a beam forming network for implementing a desired radiation pattern.

Figure 2:
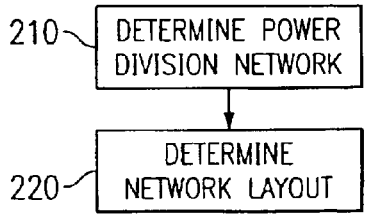
FIG. 2 shows the two primary stages of developing a passive beam forming network according to an embodiment of the present invention.

Preferred embodiments of the present invention segment design of such a beam forming network into two primary stages as shown in FIG. 2. A first such primary stage (box 210) allocates the weights utilized to produce a desired radiation pattern through a feed network branching scheme. A second such primary stage (box 220) determines the physical layout of the feed network components (e.g., microstrip lines) in a personality card of the present invention. Steps of embodiments of such two primary stages will be discussed below in further detail.

In determining a feed network configuration according to the present invention, the branching structure of a personality card may be represented as a logical tree (as shown in FIG. 1), wherein each branching node of the logical tree may produce an arbitrary number of branches. For example, embodiments of the present invention may support from one to four branches (although any number of branches may be utilized according to the present invention). Single-branch nodes might be allowed, for example, to support quarter-wave impedance transforms and/or additional line lengths to produce the desired phase relationships. The total number of terminal or output nodes (e.g., output nodes 120*a*–120*p* of FIG. 1) may be any number N, preferably corresponding to a number of antenna elements, element arrays, and/or weights of a particular phased array antenna configuration.

The structure of a branching tree of a particular personality card depends upon the distribution of desired weights, and may vary significantly from card to card. However, embodiments of the present invention preferably operate to limit the branching ratio (ratio of power distributed to the branches at a particular branching node or vertex) to practical values as it is envisioned that excessive branching ratios would result in impractical impedance ratios and feed line widths that are impractical to implement, e.g., too narrow or too wide, or are otherwise undesirable.

Determining a feed network configuration according to a preferred embodiment has a recursive structure, which means that under certain conditions it references itself. In operation according to an embodiment of the present invention a set of weights, denoted W, may be divided into subsets or groups, $W_1, W_2, \ldots, W_M$, with each group being passed to one of M branches at a branching node, with the weights again being divided into subsets or groups for passing to one of a plurality of nodes at each subsequent branching node. It should be appreciated that the number of branches M provided at any particular branching node may be different. For example, design parameters may be selected such that a number of branches at any branching node may be from 1 to 4, i.e., $M_{min}=1$ and $M_{max}=4$ such that $M_{min} \leqq M \leqq M_{max}$.

The above described process may be repeated with respect to each branch, in which case the set of weights leaving a given branching node is a subset of the original weights. The subsets may be decreased in size with each successive branching as the weights are divided up and passed to the branches emanating from a current branching node in the tree. The process preferably continues until the subset of weights at each current branching node comprises a single weight, thereby identifying the current branching nodes as terminal nodes (e.g., output nodes 102*a*–120*p* of FIG. 1) that will feed power to one antenna element or one element column of the antenna array.

A challenge is presented in selecting the aforementioned groups such that across the entire tree structure the branching ratios are minimized. Referring again to FIG. 1, it can be seen that, although branches of various different sizes are implemented in passive beam forming network 100, throughout passive beam forming network 100 the branching ratio (relative size of one branch to another branch) at each branching node in the network is substantially minimized.

Preferred embodiments of a first primary stage (e.g., box 210 of FIG. 2), allocating the weights utilized to produce a desired radiation pattern through a feed network branching scheme, are described below with reference to FIGS. 3 and 5. It should be appreciated that the steps of the preferred embodiments of FIGS. 3 and 5 substantially minimize branching ratios throughout a passive beam forming network.

Figure 3:
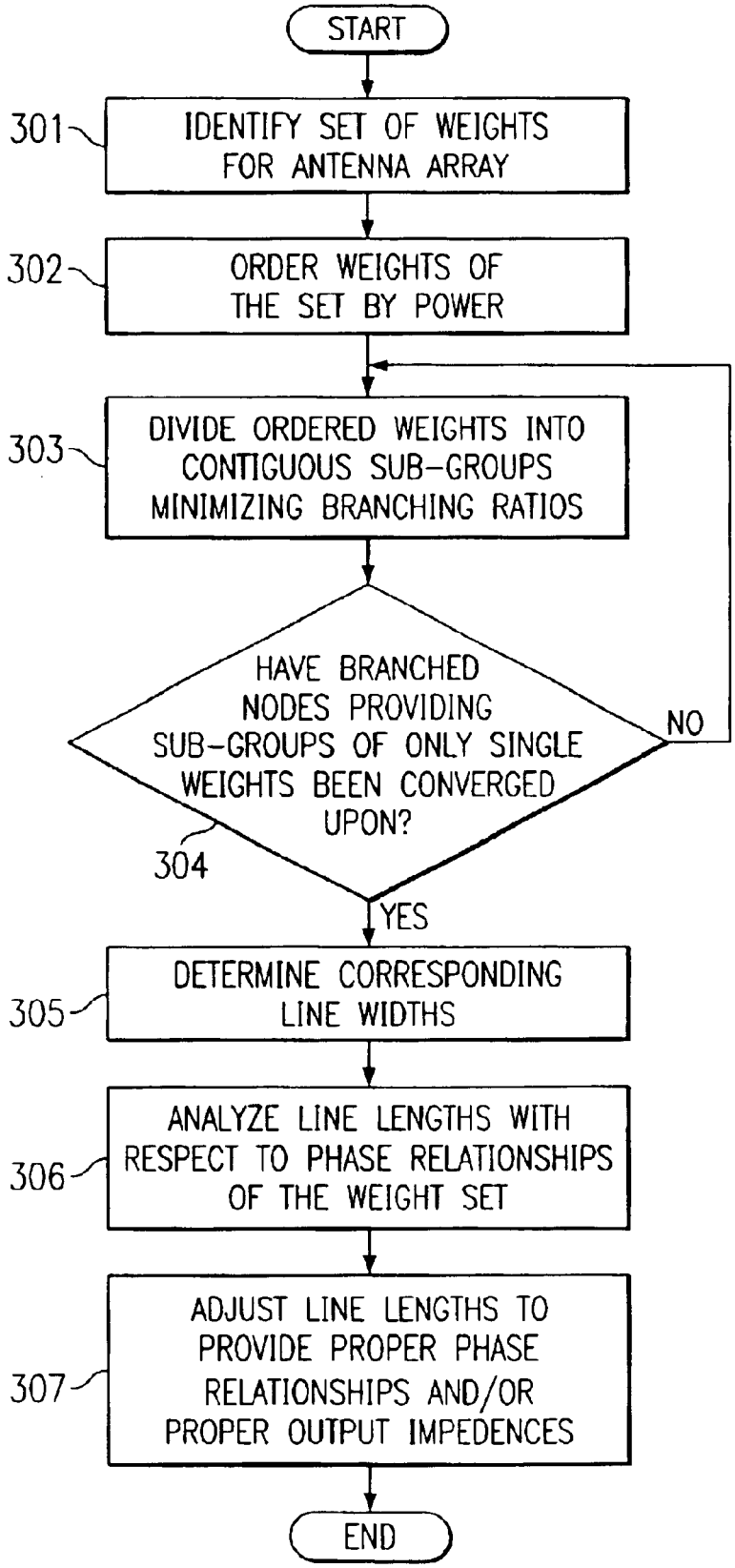
FIG. 3 shows a flow diagram of the steps of allocating the weights utilized to produce a desired radiation pattern according to an embodiment of the present invention.

With reference to FIG. 3, at step 301 the set of complex weights, $W \in \{w_1, w_2, \ldots, w_N\}$, that are to drive the individual antenna elements or element columns of the antenna array to produce a desired radiation pattern are identified. These values are preferably sorted in order, e.g., in descending order, of their amplitude (power) to obtain the set of sorted weights, $W^S \in \{w_{(1)}, w_{(2)}, \ldots, w_{(N)}\}$ at step 302. At step 303 the set of ordered weights $W^S$ is divided into contiguous subgroups, $W_1^S, W_2^S, \ldots, W_M^S$, to be passed to the branches emanating from the current node in such a way that the branching ratio is minimized. That is, each subgroup is comprised of one or more weights $w_{(1)}$ through $w_{(N)}$ such that $W_1^S \in \{w_{(l)}, \ldots w_{(k1)}\}$, $W_2^S \in \{w_{(k1+1)}, \ldots w_{(k2)}\}, \ldots W_M^S \in \{w_{(k2+1)}, \ldots w_{(N)}\}$, and so on.

According to a preferred embodiment, to find M contiguous subgroups of weights, M−1 dividing points, $k_1, k_2, \ldots,$ $k_{M-1}$ are identified, such that the first contiguous subgroup, $W_1^S$, contains the weights $\{w_{(1)}, w_{(2)}, \ldots, w(_{(k_1)}, \}$, the second contiguous subgroup contains the weights $\{w_{(k_1+1)}, w_{(k_1+2)}, \ldots, w_{(k_2)}\}$, and so on. More generally:

$$W_j^s \epsilon \begin{cases} w_1, \ldots, w_{k_1} & j=1 \\ w_{(k_{j-1}+1), \ldots, w_{(k_2)}} & 1<j<M \\ w_{(k_{m-1}+1), \ldots, w_{(M)}} & j=M \end{cases}.$$

To solve for these dividing points, the accumulated power distribution, $p_{(1)}, p_{(2)}, \ldots, p_{(N)}$, where $$p_{(k)} = \sum_{i=1}^{k} |w_{(k)}|^2 \Big/ \sum_{i=1}^{N} |w_{(i)}|^2$$

may be computed. This metric may be used to find the dividing points that minimize the branching ratios. For example, for a branch-point with two branches the power midpoint (dividing point), $$k_1 = \min_i \{|p_{(i)} - 0.5|\}$$

may be determined and, thus, one branch may be assigned the subset of $W_1 \epsilon \{w_{(1)}, \ldots, w_{(k_1)}\}$ and the other branch assigned the subset of $W_2 \epsilon \{w_{(k_1+1)}, \ldots, w_{(N)}\}$. Similarly, for M branches the dividing points from $$k_j = \min_i \{|p_{(i)} - j/M|\},$$

where $j \epsilon \{1, \ldots, M-1\}$, may be determined. In other words, the power distribution points that correspond closest to 1/M, 2/M, . . . , (M−1)/M may be determined so that roughly 1/M of the total power is delivered to each of the M branches.

Preferably, the above determinations of branch-points are repeated for each branching node, allowing the number of branches at each to vary from M=2, . . . , $M_{max}$, to identify an optimum number of branches (e.g., minimizing the branching ratio) to be implemented at each branching node. After considering all possibilities, the number of branches, $M_B$, may be selected that minimizes the ratio of power delivered to the maximum power branch to the power delivered to the minimum power branch. With this optimal number of branches ($M_B$) selected, the fraction of total power delivered to each branch may be computed from $$P_i = \begin{cases} p_{(k_1)} & i=1 \\ p_{(k_1)} - p_{(k_{i-1})} & 1<i<M_B \\ 1 - p_{(k_{M-1})} & i=M_B \end{cases}.$$

Given the impedance of the current branch, Zl, the impedances for each branch that will instantiate the power ratios determined above may be determined from $Z_i$=Zl/$P_i$. As mentioned above, in order to avoid impracticably small impedances (line widths), quarter-wave impedance transforms may be implemented between branching nodes, or otherwise as desired, as shown at branching node 130 of FIG. 1.

At step 304 a determination is made as to whether branching nodes providing subgroups of weights comprising only a single weight (i.e., output nodes) have been converged upon. If subgroups of weights comprising a plurality of weights have not been branched, processing returns to step 303 for determining the branches of a subsequent branching node. Accordingly, the illustrated process is repeated for each branch point until output nodes having a single weight of the weight set are converged upon.

If a subgroup of weights comprises only a single weight it may be assumed that an output node has been reached. Accordingly, at step 305 line widths for the feed network segments of a branching node are determined which correspond to the weight divisions determined with respect to the branching nodes.

Moreover, there may still be a need for further "branching" or other feed path manipulation, although further power division may not be implemented. For example, the feed path line lengths traversed from the input node to a particular output node associated with a weight may be analyzed to determine if line length adjustments should be made to provide a proper phase relationship at step 306. Accordingly, at step 307 one or more line lengths may be adjusted and/or subsequent branching nodes where M=1 may be added to provide a proper phase relationship at an output node. Additionally or alternatively, one or more subsequent branching nodes, where M=1, may be added to provide an impedance transform to a desired output impedance. It should be appreciated that the phase relationships relevant to steps 306 and 307 of the illustrated embodiment are dependent upon the physical layout of the beam forming network. Accordingly, steps 306 and 307, or aspects thereof, may be implemented subsequent to or in cooperation with the steps utilized in determining the physical layout of the feed network components, if desired.

Figure 4:
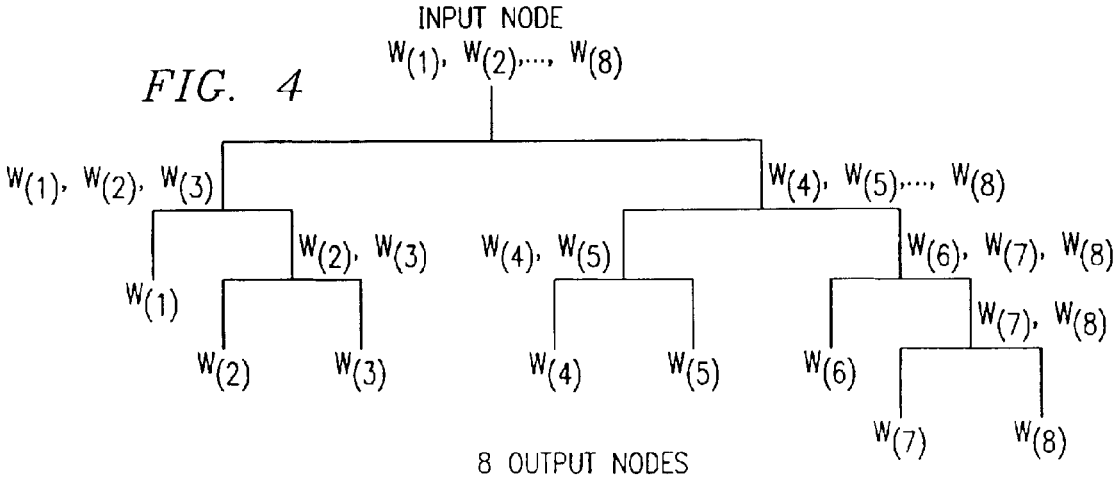
FIG. 4 shows a logical branching tree derived using the steps of FIG. 3.

FIG. 4 shows an exemplary branching tree derived using the steps set forth above. In the example of FIG. 4, N=8 nodes and $M_{max}$=2 (binary tree). The example of FIG. 4, however, does not represent line lengths for providing desired phase relationships at the output nodes.

It should be appreciated that, according to the preferred embodiment discussed above, it is important for the subgroups to be comprised of contiguous ones of the sorted weights so that similar weights (branches carrying similar power) are grouped together. Although combining a mix of larger weights with smaller weights along one branch may better equalize the powers of the emanating branches at any one particular branching node (i.e., further reduce the branching ratio), such an implementation would result in larger branching ratios downstream (at subsequent branching nodes in the tree). Accordingly, by sorting and grouping similar weights, the illustrated embodiment minimizes the maximum branching ratio across the entire tree.

Figure 5:
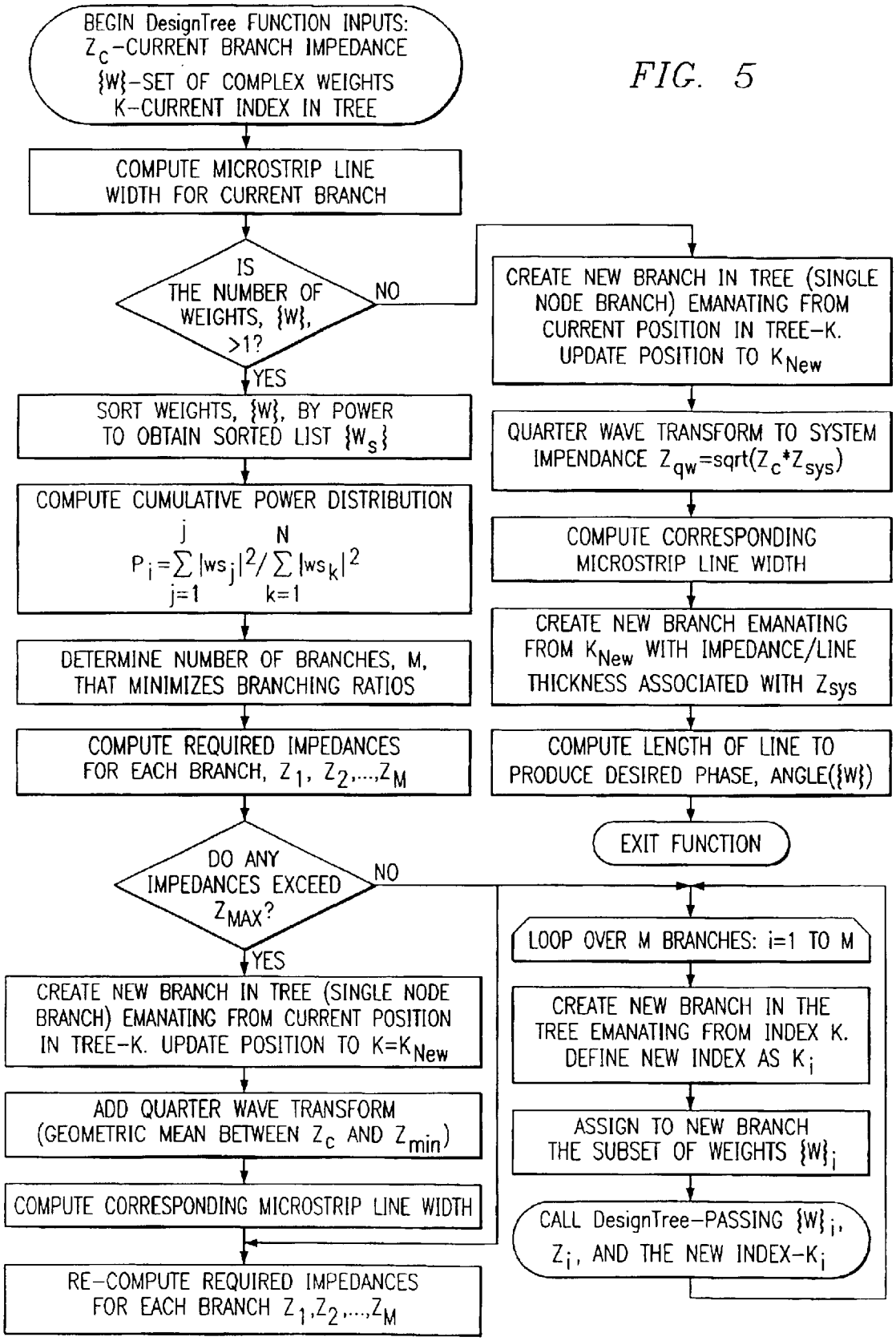
FIG. 5 shows a detailed flow diagram of the steps of allocating the weights utilized to produce a desired radiation pattern according to an embodiment of the present invention.

Detail with respect to allocation of weights utilized to produce a desired radiation pattern through a feed network branching scheme according to an embodiment of the present invention is shown in FIG. 5. The flow diagram of FIG. 5 comprises a recursive function which builds a tree structure that defines a passive beam forming network. The inputs include the current line impedance, Zc, a set of weights, {W}, and an index into the tree, K. According to the illustrated embodiment, microstrip line equations are used to compute the line width associated with the line impedance Zc and store the value in the tree.

The number of elements in the weight vector, {W}, are determined. If this vector contains more than 1 element, then processing proceeds to determine power division branching configurations. However, if there is only a single element, then this is an output node so processing proceeds to determine line length adjustments and/or output impedance matching.

When processing proceeds to determine power division branching according to the illustrated embodiment, the weights are sorted in descending order of their magnitude to obtain the set of sorted Weights, {Ws}. The set of sorted weights may then be used to compute the power distribution $$P_i = \sum_{j=1}^{i} |ws_j|^2 \Big/ \sum_{k=1}^{N} |ws_k|^2,$$

where the $ws_j$ are the individual elements of the set {Ws}, and N is the number of elements in the set {Ws}.

From the power distribution, the contiguous subsets of {Ws} to be assigned to each of the M new branches may be determined. The objective of this embodiment being to equalize, to the extent it is possible, the power assigned to each branch to minimize the branching ratios. After considering all possible branching numbers (i.e. M=2, 3, . . . , $M_{max}$), the number of branches that minimizes the branching ratios is selected.

The impedances ($Z_1$, $Z_2$, . . . , $Z_M$) that correspond to the power assigned to each branch, as determined above, may be determined. If any of the impedance values fall outside of a permissible range, e.g., require a line width that is impracticably small or impracticably large, processing may proceed to a processing branch which determines a configuration to avoid branch impedance values outside of the permissible range.

For example, if at least one impedance value utilized to set the power branching ratios determined above exceeds the design threshold, a quarter-wave impedance transform may be utilized to change the current line impedance, Zc, to the minimum allowed design impedance, $Z_{min}$. Accordingly, a single node branch may be identified to implement the quarter-wave impedance transform and the branching tree structure updated to reflect the position of this new branch. The quarter-wave transform impedance (the geometric mean of Zc and $Z_{min}$) and the corresponding line width to produce the impedance may be computed and stored in the branching tree structure. The impedances, ($Z_1$, $Z_2$, . . . , $Z_M$), utilized to set the power ratios determined above using the new branching node impedance resulting from the use of the quarter-wave impedance transform may then be determined.

Processing may proceed to loop over all M of the new branches (i=1, . . . , M) and, thus, repeat branching determinations with respect to each new branch. Similarly, if all the impedance values were within the acceptable range when the impedances were initially determined above, then processing may proceed to loop over all M of the new branches (i=1, . . . , M).

For example, a new branch emanating from index K, $K_i$, may be created in the branching tree structure. The subset of points $\{W\}_i$(e.g., the contiguous set of sorted weights emanating from branch i) may be assigned to the new branch. Thereafter, a recursive call to again implement the above steps may be made.

As each branching path reaches a point at which no further branching is desired, e.g., the number of weights of a current branch is 1, it may be assumed that an output node has been reached. Processing with respect to that branching path may proceed to implement steps to create a new branch (single node) to provide a desired output impedance. A quarter-wave transform to couple the current line impedance, Zl, to the system impedance, $Z_{sys}$, and the line width utilized to produce the impedance may be computed and stored in the tree structure. A new branch may be created to implement the quarter-wave impedance transform and the line width associated with the system impedance, $Z_{sys}$, computed and stored in the branching tree structure.

Additionally or alternatively, embodiments of the present invention operate to provide a phase relationship of the aforementioned weight set at each output node of the passive beam forming network. Accordingly, the embodiment of FIG. 5 adds line length to produce desired phase for the output associated with each output node.

Having described preferred embodiments of a first primary stage (e.g., box 210 of FIG. 2), allocating the weights utilized to produce a desired radiation pattern through a feed network branching scheme, preferred embodiments of a second primary stage (e.g., box 220 of FIG. 2), determining the physical layout of the feed network components in a personality card of the present invention, will be described below with reference to FIGS. 6, 8 and 9. Preferably, after the weights have been allocated and the logical structure of a branching tree is established as described above, the layout process begins. An objective of the preferred embodiment is a robust, automated algorithm that finds a satisfactory physical layout of the passive beam forming network.

The physical layout derived according to the preferred embodiment satisfies each of the following: The output nodes have the correct complex weights; No two branches or sections of the tree cross; Each segment of the layout is as far as possible from its neighbors to minimize coupling between the signals; and The entire layout fits within a border determined by physical constraints imposed by the size of the PCB card and/or the antenna housing.

The layout process of the preferred embodiment begins after the basic configuration of the power-division network has been determined. The structure of the network (and the tree that represents it) depends on the distribution of the N output weights. Accordingly, the layout algorithm of FIG. 6 takes as input the logical characteristics of the tree-like network, as well as a number of the physical dimensions required etcetera (steps 601 and 602). Preferably, the input specifies the number of branches at each vertex of the tree, along with the lengths and widths of each branch emanating from each vertex. According to the preferred embodiment quarter-wave impedance transforms are treated as segments with a single branch. The configuration input data for the layout process are preferably computed as part of the weight allocation procedure described above.

Figure 7A:
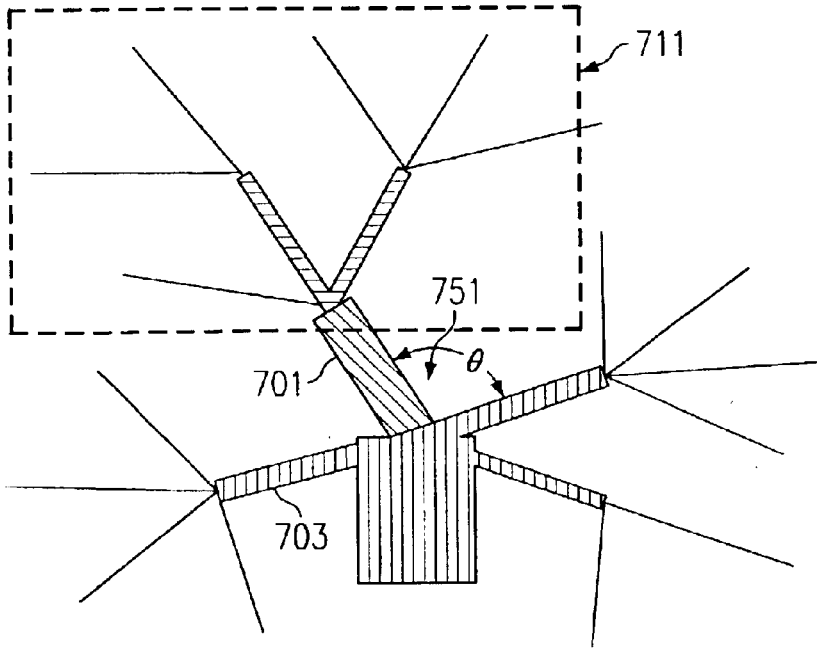
FIGS. 7A and 7B show iterations of analysis with respect to sub-trees for determining the physical layout of the feed network components according to an embodiment of the present invention.

The "core" of the preferred embodiment layout process is a recursive algorithm that traverses the tree from the base (input) to each of the N terminal nodes (outputs). Each stage in this process preferably corresponds to a particular segment (branch) in the tree (beam former network). As each segment is "visited", the branching tree may be partitioned into two sections: 1) the "sub-tree" of the segment, or set of segments "downstream" of (distal to) the current segment, and 2) the remainder of the tree, or all segments except the current segment and the segments in its sub-tree (i.e., the first partition). Directing attention to FIGS. 7A and 7B, sub-trees identified at different stages in the process are shown within boxes 711 and 712, respectively, with the remainder of the tree shown external thereto.

After partitioning the tree as described above, various attachment angles between the current segment and its "parent" segment are preferably considered. Each angle preferably corresponds to a particular rotation of the current segment and its entire sub-tree (first partition) about the point at which the current segment attaches to its parent branching node. According to preferred embodiments, at each rotation angle, the distance between every segment in first partition and every segment in the second partition is computed and the smallest of these distances is noted. An optimal angle may be identified as the angle that produces the largest minimum distance value between the two sets of segments. This reduces electromagnetic coupling between the various signal paths (i.e., improves isolation). Once the optimal angle is determined, the current segment and its sub-tree may be rotated by that angle, and a new segment may be chosen to be the current segment (i.e., the tree is traversed to the next segment). This process is preferably repeated until the entire tree has been traversed (every segment of the network has been visited). A complete pass through the entire tree represents one iteration of a process that is preferably repeated several times, as described below.

Figure 6:
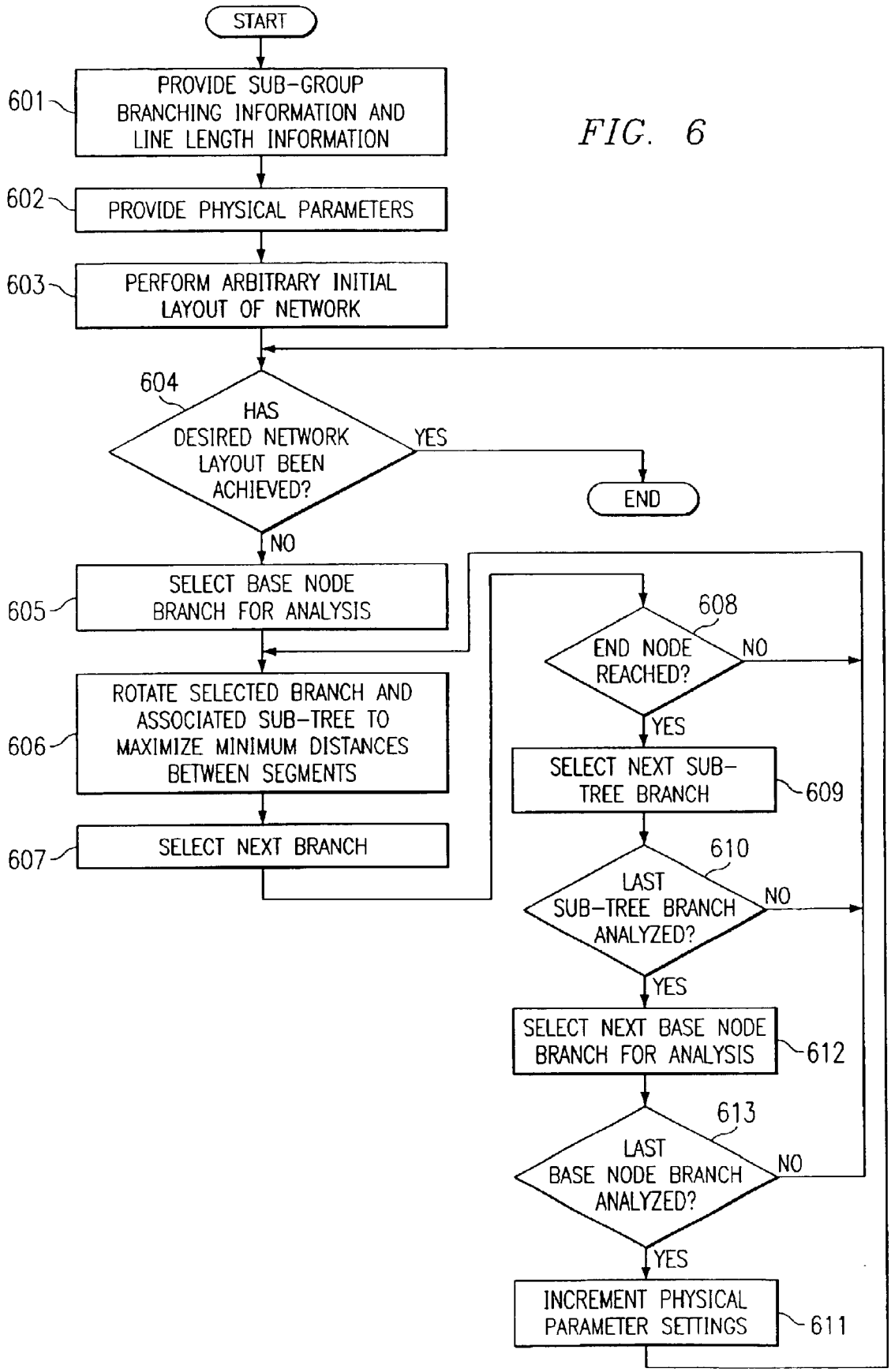
FIG. 6 shows a flow diagram of the steps of determining the physical layout of the feed network components of a passive beam forming network according to an embodiment of the present invention.

In order to provide a starting point for the above described rotation angle analysis, the embodiment illustrated in FIG. 6 provides an initial layout, such as may be arbitrarily constructed by laying the segments of each path end-to-end along a straight line, at step 608. Thus, the initial layout may comprise multiple paths overlapping one another along a single line emanating from the input node (base of the tree).

At step 604, a looping process begins. For example, a determination may be made (step 604) as to whether a desired network layout, i.e., one which meets the design parameters, has been achieved. If so, processing of the physical layout of the beam forming network is complete according to the illustrated embodiment. However, if a desired network layout has not been achieved, processing proceeds to analyze every segment of the branching network.

At step 605 a branch from the base (input) node (e.g., branch 701 of FIG. 7A) of the branching network is selected to begin a first or new iteration of the analysis. The selected branch and associated sub-tree are preferably rotated or moved throughout various angles θ with respect to a pivot point (e.g., pivot point 751 of FIG. 7A) at step 606. Such rotation is preferably continued until the minimum distance between the segments in the sub-tree and the segments in the rest of the tree (straight line, initially) is maximized. The attachment angles of end-node segments are preferably chosen to maximize the distance between their end-points and the segments in the rest of the tree.

Figure 7B:
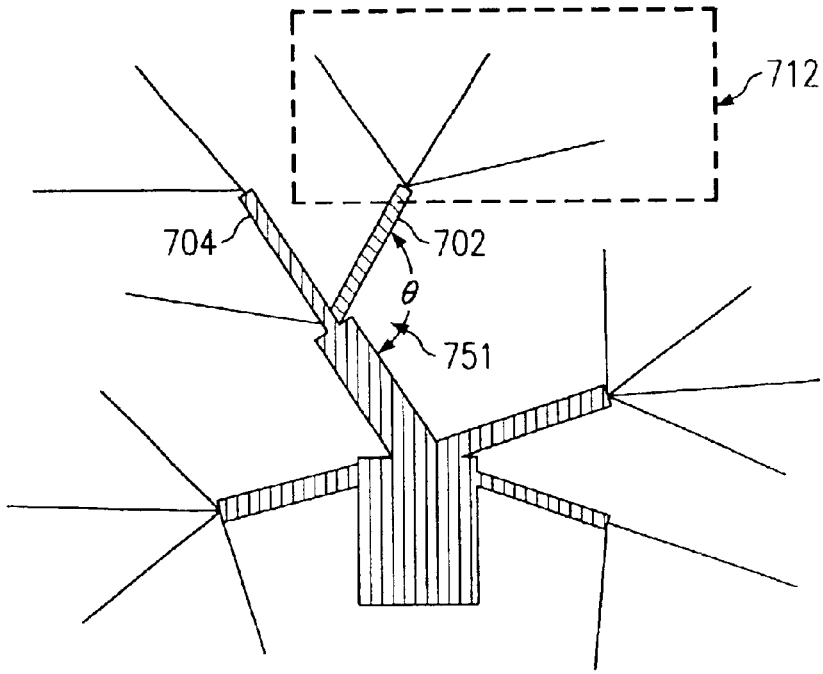

At step 607, a next branch of the sub-tree may be selected (e.g., branch 702 of FIG. 7B). If at step 608, it is determined that an end node (output node) has not already been reached, the process may be repeated with respect to the newly selected branch, rotating this new branch and its sub-tree with respect to a pivot point (e.g., pivot point 751 of FIG. 7B). If it is determined that an end node (output node) has already been reached, another branch in the sub-tree (e.g., branch 704 of FIG. 7B) may be selected at step 609. If it is determined that a last branch of a sub-tree associated with a particular base node branch has not already been analyzed at step 610, the above analysis may be repeated for the selected branch, rotating this new branch and its sub-tree with respect to a pivot point. However, if it is determined (step 610) that a last branch of a sub-tree associated with a particular base node has already been analyzed (the sub-tree associated with a particular base node branch has been fully traversed), the process may proceed to step 612 to select a next base node branch (e.g., branch 703 of FIG. 7A) for analysis.

Accordingly, the preferred embodiment process may continue recursively until all end nodes (terminal node, or output nodes) have been reached, as may be determined by step 613. Accordingly, processing may again proceed to step 604 wherein it is determined if a desired network layout has been achieved, e.g., does the layout fit within the area of a PCB board, are there no overlapping feed lines, have the distances between the various feed lines been maximized, et cetera.

Starting with the layout resulting from one pass through the full tree (network), the entire process (excluding the initialization step) is preferably repeated several times with successively refined searches for the best branch angles (successively smaller angular range searched, with finer discretization). Accordingly, after the first iteration, physical parameter settings, such as branching node angular ranges and/or overall dimensions of the passive beam forming network are preferably incrementally reduced (step 611). This may be accomplished by only considering rotations that satisfy these constraints as the tree is traversed.

As discussed above with respect to steps 306 and 307 of FIG. 3, once the layout of the basic network structure is complete, additional line lengths may be added to each path to obtain the desired relative phase. This extra length is also preferably grown in segments using the algorithm described above to prevent line crossings and to minimize potential coupling effects between the paths (by keeping the distances between segments as large as possible). The growth of the segments is also preferably constrained to fit within the rectangle defined by the physical size of the board.

Figure 8:
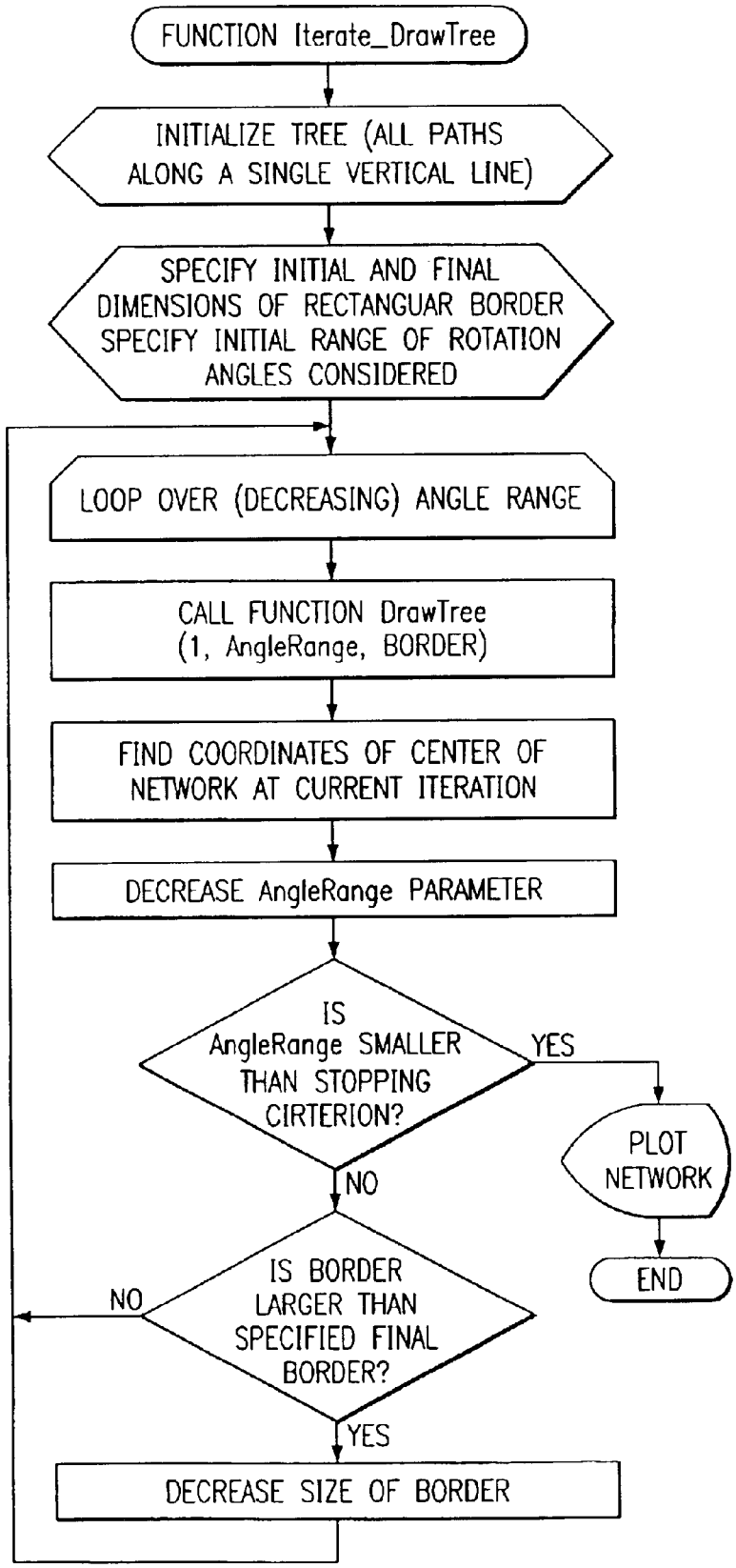
FIGS. 8 and 9 show detailed flow diagrams of the steps of determining the physical layout of the feed network components according to an embodiment of the present invention.
Figure 9:
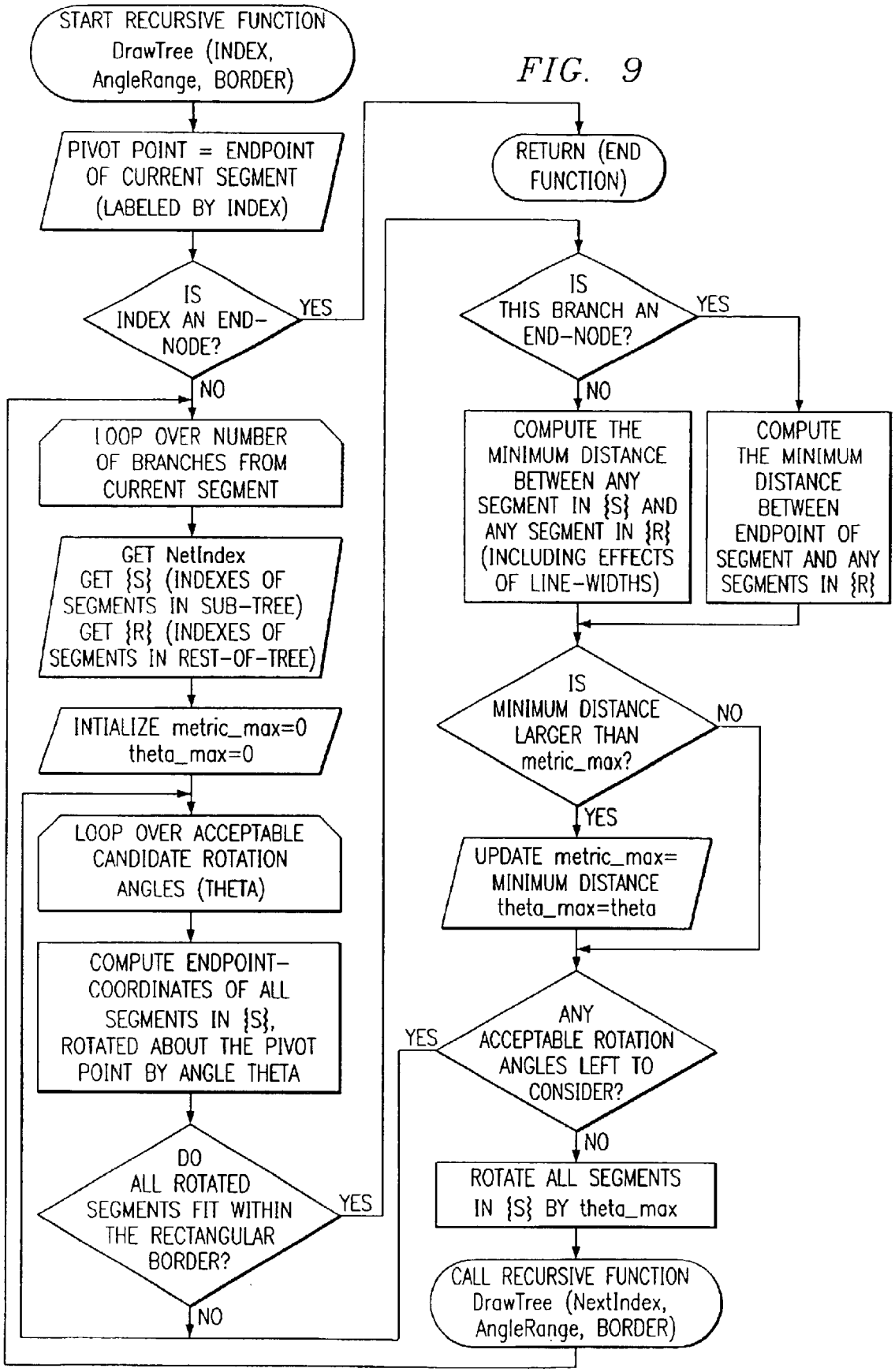

Detail with respect to a preferred embodiment for determining the physical layout of the feed network components in a personality card of the present invention is shown in FIGS. 8 and 9. Specifically, FIG. 8 illustrates detail with respect to a preferred embodiment physical layout algorithm while FIG. 9 illustrates detail with respect to a recursive function of FIG. 8.

The illustrated embodiment of FIG. 8 initializes the tree by overlaying all paths through the tree on top of each other in along a single vertical line. Thereafter, initial and final dimensions of the rectangular border and initial and final ranges of rotation angles to be considered may be specified. A loop may be implemented to converge on the final range of rotation angles.

Within this loop, a recursive "DrawTree" algorithm (e.g., the algorithm of FIG. 9 discussed below) may be called, preferably specifying a number of parameters, such as Index, AngleRange, and Border. Specifying Index =1, for example, may be utilized to cause the DrawTree algorithm to start at the base of the tree (input node). The coordinates of the mid-point of network returned by the DrawTree algorithm may be determined.

The angle range to be utilized by a subsequent iteration of the DrawTree algorithm may be incremented by a preset factor (e.g., multiply current AngleRange by 0.8). A determination is preferably made as to whether the current angle range is smaller than a minimum angle range. If the current angle range is smaller than a minimum angle range the passive beam forming network configuration is preferably stored as a desired solution and processing of the algorithm may terminate.

Otherwise, a determination is preferably made as to whether the current border size exceeds the final size of the PCB design criteria. If the current border size does exceed the final size, the current border size is preferably decreased, such as by a predetermined amount or percentage and the recursive loop repeated. If the current border size does not exceed the final size, the current border size preferably remains the same and the recursive loop repeated.

It should be appreciated that the passive beam forming network layout determined according to the above methodology may be utilized in a number of ways. For example, the configuration may be displayed or printed for use by an engineer. However, the passive beam forming network layout is preferably plotted and converted to a format that can provide instructions to a programmable milling machine to thereby facilitate automated manufacturing of a personality card of the present invention.

Referring now to FIG. 9, a preferred embodiment recursive algorithm, e.g., DrawTree algorithm, as may be utilized in the recursive loop of FIG. 8 above, is shown. The algorithm of FIG. 9 begins by receiving a function call with associated parameters, such as Index, AngleRange, and Border. Preferably, Index labels the current node (segment) being processed. Accordingly, the first call to this algorithm preferably refers to the input node at the base of the tree (Index =1). AngleRange preferably specifies the range of rotation angles considered for the sub-tree of the current segment. This may be decreased in each successive pass through the tree. Border preferably specifies the constraint imposed by the border, within which the entire network is to be fit. This may be initialized to a large size in the first pass though the tree, but is preferably decreased in successive iterations until the desired size is reached.

Preferably, the coordinates of the pivot point are given by the end-point of the current segment specified by Index. If the current segment is an end-node, then the algorithm preferably terminates and returns to a calling algorithm (e.g., the physical layout algorithm of FIG. 8). According to a preferred embodiment, the algorithm will return to the previous vertex and visit a branch from that vertex if any have not yet been visited. If there are none left, then it returns the vertex prior to that, etcetera. This process continues until it returns to the base of the tree (input node), and there are no branches emanating from there that have not been visited. That marks the end of one iteration, or pass through the entire tree.

If the current segment is not an end-node, then each of its branches are preferably visited in turn (loop over all branches emanating from the current segment). For example, the index of the next branch to visit may be determined, and the tree partitioned into those segments that are part of the current segments sub-tree (set {S}) and those in the rest of the tree (set {R}). The indexes of the segments in each partition may be identified and the distance metric and default rotation angle (zero degrees) initialized.

Preferably, analysis with respect to each branch loops over all acceptable candidate rotation angles (depends on AngleRange), θ. Accordingly, for each angle considered, the algorithm may compute the coordinates of the endpoints of each segment in the set {S} (sub-tree of the current segment) corresponding to a rotation θ about the pivot point. If any of the rotated segments are not entirely contained within the rectangular border, the process may proceed to the next candidate rotation angle. If all the rotated segments fit within the border, then the process may proceed to compute the distance between all the segments in {S} and all the segments in {R}. If there is only one segment in {S} (the branch is an end-node), then the process may compute the distance between its end-point and all the segments in {R}. If the smallest distance found is larger than metric_max, then the metric_max may be updated to this new value and the metric theta_max set to θ.

The above is preferably repeated with respect to all candidate rotation angles. When no more acceptable rotation angles are left to consider, the process preferably rotates all segments in {S} and current branch by theta_max about the pivot point. Thereafter, the recursive function may be again called to analyze another branch in the segment. When the DrawTree algorithm returns, the process preferably proceeds to a next branch (if any) and repeats the above branch loop steps. If there are no branches left, then the DrawTree algorithm preferably returns to a previous level in the branching tree. If the previous level is the tree base (input node) and all the branches have been visited, then the entire procedure ends (one iteration).

It should be appreciated that the above process, starting again at the base of the tree, is repeated a plurality of times according to preferred embodiments of the present invention. Such multiple iterations are preferred because, after one iteration, it is possible that not all of the design criteria will be met. For example, after one or two iterations some of the branches of the tree may cross each other, the branches may lie too close together, and/or the branches may extend beyond the rectangular boundary into which the beam forming network is to be constrained. By iterating this process several times, the preferred embodiment algorithm converges upon a network configuration that satisfies the design criteria.

Iterations of the preferred embodiment increment various design parameters in order to facilitate convergence upon a desired passive beam forming network For example, the desired passive beam forming network of a preferred embodiment is to be constrained to lie within the rectangular boundaries of a personality card PCB. However, as each stage in the process when the current segment and its sub-tree are rotated, only those rotations that satisfy that constraint are allowed. According to the preferred embodiment, rotations that would put some of the segments outside the boundaries are not considered and, therefore, imposing the final boundary constraints immediately (in the very early iterations of the process) might significantly limit the available degrees of freedom in arriving at the final configuration. Accordingly, the preferred embodiment begins with a very large boundary which is iteratively reduced in size.

When implemented in software, the elements of the present invention are essentially the code segments to perform the necessary tasks. The program or code segments can be stored in a computer readable medium or transmitted by a computer data signal embodied in a carrier wave, or a signal modulated by a carrier, over a transmission medium. The computer readable medium may include any medium that can store or transfer information. Examples of the computer readable medium include an electronic circuit, a semiconductor memory device, a ROM, a flash memory, an erasable ROM (EROM), a floppy diskette, a compact disk CD-ROM, an optical disk, a hard disk, a fiber optic medium, a radio frequency (RF) link, etcetera. The computer data signal may include any signal that can propagate over a transmission medium such as electronic network channels, optical fibers, air, electromagnetic, RF links, etcetera. The code segments may be downloaded via computer networks such as the Internet, an intranet, a local area network (LAN), a wide area network (WAN), etcetera.

Figure 10:
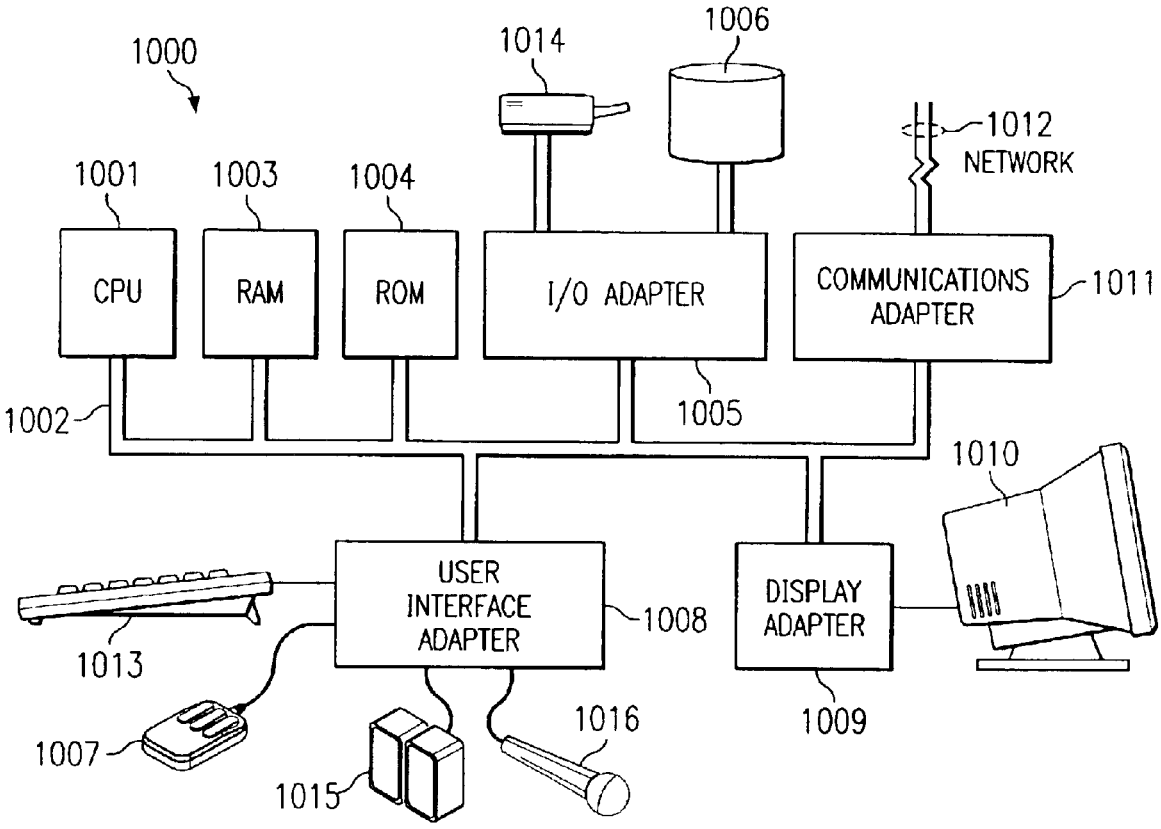
FIG. 10 shows a processor-based system for implementing the steps of preferred embodiments of the present invention.

FIG. 10 illustrates computer system 1000 adapted to use the present invention. Central processing unit (CPU) 1001 is coupled to system bus 1002. The CPU 1001 may be any general purpose CPU, such as an Intel PENTIUM processor. However, the present invention is not restricted by the architecture of CPU 1001 as long as CPU 1001 supports the inventive operations as described herein. Bus 1002 is coupled to random access memory (RAM) 1003, which may be SRAM, DRAM, or SDRAM. ROM 1004 is also coupled to bus 1002, which may be PROM, EPROM, or EEPROM. RAM 1003 and ROM 1004 hold user and system data and programs as is well known in the art.

Bus 1002 is also coupled to input/output (I/O) controller card 1005 communications adapter card 1011, user interface card 1008, and display card 1009. The I/O adapter card 1005 connects to storage devices 1006, such as one or more of a hard drive, a CD drive, a floppy disk drive, a tape drive, to the computer system. The I/O adapter 1005 is also connected to printer 1014, which would allow the system to print paper copies of information such as a passive beam forming network configuration determined according to the present invention. Note that the printer may a printer (e.g. dot matrix, laser, etc.), a fax machine, a copier machine, or even a computerized milling machine. Communications card 1011 is adapted to couple the computer system 1000 to a network 1012, which may be one or more of a telephone network, a local (LAN) and/or a wide-area (WAN) network, an Ethernet network, and/or the Internet network. User interface card 1008 couples user input devices, such as keyboard 1013, pointing device 1007, and microphone 1016, to the computer system 1000. User interface card 1008 also provides sound output to a user via speaker(s) 1015. The display card 1009 is driven by CPU 1001 to control the display on display device 1010.

It should be appreciated that, although preferred embodiments have been discussed above with reference to passive beam forming networks providing dividing signal power for energizing antenna elements to produce a desired radiation pattern, embodiments of the invention are not limited to any particular wireless link direction. Accordingly, the concepts of the present invention apply to beam forming networks for combining signal energy as received by antenna elements of an antenna array.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method comprising:

determining a power division branching network having a plurality of branching nodes coupled to a plurality of output nodes, wherein a ratio of power distributed to branches at said plurality of branching nodes is minimized throughout said branching network;

determining an optimal physical layout configuration of said branching network, wherein said determining said optimal physical layout configuration comprises dividing said branching network into a current sub-tree, including a current branching node and all coupled subsequent branching nodes, and a remainder of said branching network, including all branching nodes other than said branching node and said coupled subsequent branching nodes; and rotating said current sub-tree at various angles about a pivot point.

2. The method of claim 1, wherein said various angles comprise a predetermined range of angles.

3. The method of claim 2, further comprising:

decreasing said range of angles upon subsequent iterations of said rotating said current sub-tree at various angles about said pivot point.

4. The method of claim 1, further comprising:

determining an angle of said various angles maximizing a minimum distance between segments of said branching nodes of said current sub-tree and segments of said branching nodes of said remainder of said branching network.

5. A method comprising:

determining a power division branching network having a plurality of branching nodes coupled to a plurality of output nodes, wherein a ratio of power distributed to branches at said plurality of branching nodes is minimized throughout said branching network;

determining an optimal physical layout configuration of said branching network; and stepping through analysis of each branching node of said plurality of branching nodes in multiple iterations.

6. The method of claim 5, further comprising:

reducing a boundary within which said branching network is confined at subsequent iterations of said analysis.

7. The method of claim 5, further comprising:

reducing a range of branch rotation angles at subsequent iterations of said analysis.

8. A method comprising:

determining a power division branching network having a plurality of branching nodes coupled to a plurality of output nodes, wherein a ratio of power distributed to branches at said plurality of branching nodes is minimized throughout said branching network; and determining an optimal physical layout configuration of said branching network, wherein said optimal layout configuration includes said output nodes having corresponding weights of a weight set associated therewith, no two branches of the branching network crossing, each branch of said branching network is a maximum distance from neighboring branches, and the branching network fits within a predetermined border.

9. A method for providing a passive beam forming network, said method comprising:

identifying a set of weights associated with a desired radiation pattern configuration;

ordering weights of said set by an amplitude of each weight to provide an ordered set;

determining a power division branching network wherein division of weights at branching nodes of said branching network provide subsets of contiguous weights of said ordered set; and determining an optimal physical layout configuration of said branching network.

10. The method of claim 9, wherein said determining a power division branching network comprises:

determining a number of branches at a branching node providing a minimum ratio of power distributed to branches of said branching node.

11. The method of claim 10, wherein said determining said number of branches comprises:

analyzing power ratios with respect a range of branch numbers.

12. The method of claim 9, wherein said determining said optimal physical layout configuration comprises:

dividing said branching network into a current sub-tree, including a current branching node and all coupled subsequent branching nodes, and a remainder of said branching network, including all branching nodes other than said branching node and said coupled subsequent branching nodes.

13. The method of claim 12, further comprising:

rotating said current sub-tree at various angles about a pivot point.

14. The method of claim 13, wherein said various angles comprise a predetermined range of angles.

15. The method of claim 13, further comprising:

determining an angle of said various angles maximizing a minimum distance between segments of said branching nodes of said current sub-tree and segments of said branching nodes of said remainder of said branching network.

16. The method of claim 9, further comprising:

stepping through analysis of each branching node of said plurality of branching nodes in multiple iterations.

17. The method of claim 16, further comprising:

reducing a boundary within which said branching network is confined at subsequent iterations of said analysis.

18. The method of claim 16, further comprising:

reducing a range of branch rotation angles at subsequent iterations of said analysis.

19. A method comprising:

determining a power division branching network having a plurality of branching nodes coupled to a plurality of output nodes; and determining an optimal physical layout configuration of said branching network at least in part by rotating each branching node at various angles about a pivot point.

20. The method of claim 19, wherein said various angles comprise a predetermined range of angles.

21. The method of claim 20, further comprising:

decreasing said range of angles upon subsequent iterations of said rotating said current sub-tree at various angles about said pivot point.

22. The method of claim 19, wherein said determining said optimal physical layout configuration comprises:

dividing said branching network into a current sub-tree, including a current branching node and all coupled subsequent branching nodes, and a remainder of said branching network, including all branching nodes other than said branching node and said coupled subsequent branching nodes.

23. The method of claim 22, further comprising:

determining an angle of said various angles maximizing a minimum distance between segments of said branching nodes of said current sub-tree and segments of said branching nodes of said remainder of said branching network.

24. The method of claim 19, wherein a ratio of power distributed to branches at said plurality of branching nodes is minimized throughout said branching network.

25. The method of claim 24, wherein each said output node of said plurality of output nodes has a beam forming weight associated therewith, wherein said determining a power division branching network comprises:

ordering said weights in an amplitude order; and selecting branching at said branching nodes to include contiguous subsets of weights as ordered in said amplitude order.

26. The method of claim 19, wherein said determining a power division branching network comprises:

determining a number of branches at a branching node providing a minimized ratio of power distributed to said branches.

27. The method of claim 26, wherein said determining said number of branches comprises:

analyzing power ratios with respect a range of branch numbers.

28. A system comprising:

means for determining a power division branching network having a plurality of branching nodes coupled to a plurality of output nodes, wherein a ratio of power distributed to branches at said plurality of branching nodes is minimized throughout said branching network, wherein said means for determining a power division branching network comprises means for determining a number of branches at a branching node providing said minimized ratio of power distributed to said branches; and means for determining an optimal physical layout configuration of said branching network.

29. The system of claim 28, wherein each said output node of said plurality of output nodes has a beam forming weight associated therewith, wherein said means for determining a power division branching network comprises:

means for ordering said weights in an amplitude order; and means for selecting branching at said branching nodes to include contiguous subsets of weights as ordered in said amplitude order.

30. The system of claim 28, wherein said means for determining said optimal physical layout configuration comprises:

means for dividing said branching network into a current sub-tree, including a current branching node and all coupled subsequent branching nodes, and a remainder of said branching network, including all branching nodes other than said branching node and said coupled subsequent branching nodes.

31. A system comprising:

means for determining a power division branching network having a plurality of branching nodes coupled to a plurality of output nodes, wherein a ratio of power distributed to branches at said plurality of branching nodes is minimized throughout said branching network;

means for determining an optimal physical layout configuration of said branching network, wherein said means for determining said optimal physical layout configuration comprises means for dividing said branching network into a current sub-tree, including a current branching node and all coupled subsequent branching nodes, and a remainder of said branching network, including all branching nodes other than said branching node and said coupled subsequent branching nodes; and means for rotating said current sub-tree at various angles about a pivot point.

32. The system of claim 31, further comprising:

means for determining an angle of said various angles maximizing a minimum distance between segments of said branching nodes of said current sub-tree and segments of said branching nodes of said remainder of said branching network.

33. A system comprising:

means for determining a power division branching network having a plurality of branching nodes coupled to a plurality of output nodes, wherein a ratio of power distributed to branches at said plurality of branching nodes is minimized throughout said branching network;

means for determining an optimal physical layout configuration of said branching network; and means for stepping through analysis of each branching node of said plurality of branching nodes in multiple iterations.

34. The system of claim 33, further comprising:

means for reducing a boundary within which said branching network is confined at subsequent iterations of said analysis.

35. The system of claim 33, further comprising:

means for reducing a range of branch rotation angles at subsequent iterations of said analysis.

36. A system comprising:

means for determining a power division branching network having a plurality of branching nodes coupled to a plurality of output nodes; and means for determining an optimal physical layout configuration of said branching network including means for rotating each branching node at various angles about a pivot point.

37. The system of claim 36, wherein said various angles comprise a predetermined range of angles.

38. The system of claim 37, further comprising:

means for decreasing said range of angles upon subsequent iterations of implementing said means for rotating said current sub-tree at various angles about said pivot point.

39. The system of claim 36, wherein said means for determining said optimal physical layout configuration comprises:

means for dividing said branching network into a current sub-tree, including a current branching node and all coupled subsequent branching nodes, and a remainder of said branching network, including all branching nodes other than said branching node and said coupled subsequent branching nodes.

40. The system of claim 39, further comprising:

means for determining an angle of said various angles maximizing a minimum distance between segments of said branching nodes of said current sub-tree and segments of said branching nodes of said remainder of said branching network.

41. The system of claim 36, wherein a ratio of power distributed to branches at said plurality of branching nodes is minimized throughout said branching network.

42. The system of claim 41, wherein each said output node of said plurality of output nodes has a beam forming weight associated therewith, wherein said means for determining a power division branching network comprises:

means for ordering said weights in an amplitude order; and means for selecting branching at said branching nodes to include contiguous subsets of weights as ordered in said amplitude order.

* * * * *